US006923862B2

(12) United States Patent
Le Tiec et al.

(10) Patent No.: US 6,923,862 B2
(45) Date of Patent: Aug. 2, 2005

(54) DEVICE FOR COATING A CONDUCTOR WIRE

(75) Inventors: Pierre-Yves Le Tiec, Tergnier (FR); Michel Debray, Autreville (FR); Vincent Boutte, Saint Quentin (FR)

(73) Assignee: Nexans, Paris (FR)

( * ) Notice: Subject to any disclaimer, the term of this patent is extended or adjusted under 35 U.S.C. 154(b) by 89 days.

(21) Appl. No.: 10/419,681

(22) Filed: Apr. 21, 2003

(65) Prior Publication Data

US 2004/0058292 A1 Mar. 25, 2004

(30) Foreign Application Priority Data

Apr. 26, 2002 (FR) ..... 02 05817

(51) Int. Cl.[7] ..... B05C 13/02
(52) U.S. Cl. ..... 118/67; 118/712
(58) Field of Search ..... 118/67–69, 61, 118/663, 712, 325, 420, DIG. 19; 34/630, 640, 79, 86; 432/8, 72, 59, 47

(56) References Cited

U.S. PATENT DOCUMENTS

| | | | | |
|---|---|---|---|---|
| 3,810,736 A | * | 5/1974 | Dumas | 432/59 |
| 4,938,689 A | | 7/1990 | Macocco et al. | 432/59 |
| 6,186,089 B1 | * | 2/2001 | Le Tiec et al. | 118/67 |

FOREIGN PATENT DOCUMENTS

| | | |
|---|---|---|
| DE | 2019410 | 11/1970 |
| DE | 3717166 | 12/1988 |
| DE | 3741328 | 6/1989 |
| EP | 875299 | 11/1998 |
| FR | 1086506 | 2/1955 |

OTHER PUBLICATIONS

Preliminary Search report dated Jan. 13, 2003.

* cited by examiner

*Primary Examiner*—Chris Fiorilla
*Assistant Examiner*—Yewebdar Tadesse

(57) ABSTRACT

The invention provides a device for coating a conductor wire, the device comprising an enameling oven, the oven comprising a chamber through which the wire coated in an enameling varnish passes, and being provided for this purpose with a wire inlet and a wire outlet, and with means for heating the wire along its path within the chamber in order to evaporate solvent from the varnish and bake the varnish on the wire, the atmosphere inside the chamber having low oxygen content, the chamber further comprising a fan and an air feed inlet communicating with the chamber and servo-controlled to means for measuring the oxygen content. In the device, the fan and the air feed inlet are situated in distinct positions that are spaced apart from each other, the fan being situated between the solvent evaporation zone and the air feed inlet in such a manner as to entrain the solvent towards the air feed inlet so that the solvent is treated by combustion outside the zone in which the varnish is baked.

3 Claims, 1 Drawing Sheet

DEVICE FOR COATING A CONDUCTOR WIRE

The present invention relates to a device for coating a conductor wire.

BACKGROUND OF THE INVENTION

Document EP-0 875 299 discloses a device for coating a conductor wire which comprises an applicator for applying varnish on the wire and an enameling oven through which the wire passes. For this purpose, the oven comprises a chamber fitted with heater elements facing the path followed by the wire in order to evaporate the solvent from the varnish and also to bake the varnish. The solvent vapor is processed by combustion on coming into contact with the heater elements, without any resulting flames, under a controlled atmosphere having low oxygen content. For this purpose, the chamber has a probe for measuring oxygen content and an air inlet opening which is servo-controlled to the measurements performed by the probe. According to that document, a fan is mounted facing the air feed inlet. Thus, air flows through the chamber, and the flow of incoming air mixes with the flow of air and vapor already present in the chamber.

Although that device presents numerous advantages, it nevertheless does not give full satisfaction.

It turns out that part of the flow of incoming air is directed by the fan towards the varnish applicator, thereby having the consequence of damaging the quality of the coating and of causing the solvent to oxidize immediately, thereby creating flames on the surface of the wire and damaging the quality of the coating.

OBJECTS AND SUMMARY OF THE INVENTION

An object of the present invention is to remedy those drawbacks, and in particular to devise a coating device for coating a conductor wire that enables an enameled wire to be obtained without leading to flames being created on the surface of the wire inside the enameling oven.

For this purpose, the present invention provides a device for coating a conductor wire, the device comprising an enameling oven, said oven comprising a chamber through which said wire coated in an enameling varnish passes, and being provided for this purpose with a wire inlet and a wire outlet, and with means for heating said wire along its path within said chamber in order to evaporate solvent from said varnish and bake said varnish on said wire, the atmosphere inside said chamber having low oxygen content, said chamber further comprising a fan and an air feed inlet communicating with said chamber and servo-controlled to means for measuring said oxygen content, wherein said fan and said air feed inlet are situated in distinct positions that are spaced apart from each other, said fan being situated between the solvent evaporation zone and said air feed inlet in such a manner as to entrain said solvent towards said air feed inlet so that said solvent is treated by combustion outside the zone in which said varnish is baked.

By means of the invention, it is ensured that evaporated solvent is not entrained towards the wire, thereby preventing flames forming on the surface of the coated wire. This enables the quality of the coating to be improved very significantly.

In most advantageous manner, the treatment of said solvent by combustion takes place in a "combustion" zone for burning said solvents and communicating with said chamber.

Said fan is situated in front of said air feed inlet relative to the flow direction of said solvent.

According to an advantageous characteristic of the invention, an air feed duct communicating at its two ends with said chamber, and also with said air feed inlet, is provided inside said oven so as to form a closed gas circulating circuit, said circuit comprising said varnish baking zone, said solvent evaporation zone, and said solvent combustion zone, the gas circulating around said circuit in the opposite direction to the travel direction of said wire inside said chamber.

BRIEF DESCRIPTION OF THE DRAWING

Other characteristics and advantages of the present invention appear from the following description of an embodiment of the invention, given by way of non-limiting illustration.

The sole FIGURE is a highly diagrammatic section view of a device of the invention for coating a conductor wire.

MORE DETAILED DESCRIPTION

Figure 1:
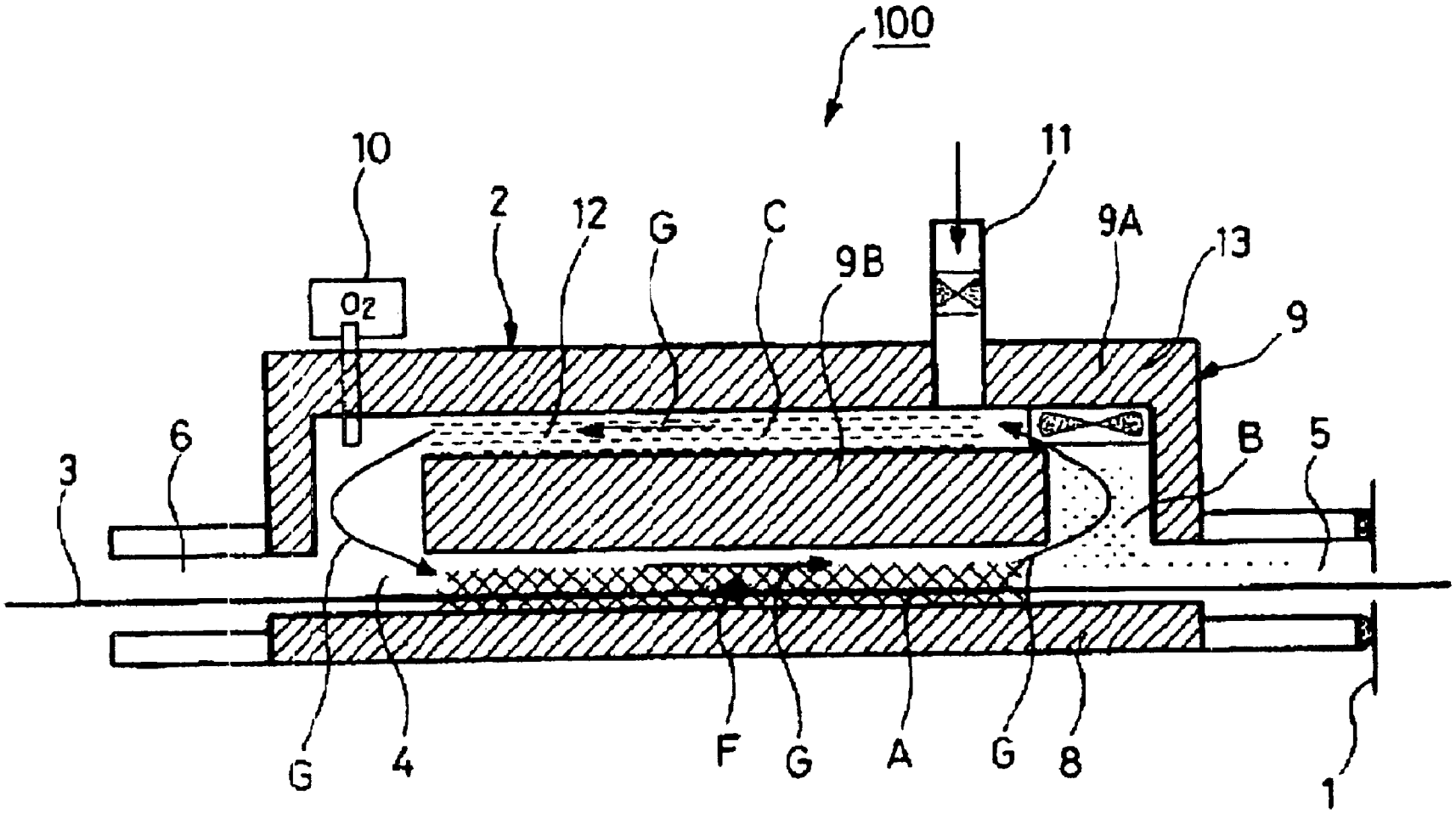

The device 100 comprises a varnish applicator 1 and an enameling oven 2 mounted after the applicator and coupled thereto, with a conductor wire 3 passing through them, horizontally in the example shown. Naturally, in a variant, the device 100 could be disposed vertically. The varnish applicator 1 contains varnish dissolved in solvent so as to deposit a layer of the varnish on the wire 3 as it passes through the applicator.

The enameling oven 2 comprises a single chamber 4 for evaporating the solvents from the layer of varnish on the wire, for processing the solvent vapor, and for high temperature baking of the varnish on the wire, as the wire travels through the chamber.

The oven 2 has an inlet 5 and outlet 6 for the wire 3 leading to and from the chamber 4 and provided at opposite ends thereof. The oven also has a bottom longitudinal wall 8 and a top longitudinal wall 9 which is preferably a double wall 9A, 9B. The oven 2 is also fitted with radiating heater elements (not shown) mounted in the chamber 4 facing the path followed by the wire 3 therein, e.g. in the wall 9A. These elements are electrical resistors designed to enable the chamber 4 to be raised to a temperature of about 1000° C.

As described in document EP-0 875 299, the chamber 4 is preferably a chamber in which the inside atmosphere has low oxygen content, e.g. less than 6% and preferably less than 3%. This content is monitored. For this purpose, the chamber 4 is fitted with a probe 10 for measuring the oxygen content of the atmosphere inside the chamber 4. A controlled air inlet 11 is servo-controlled to the probe 10 and enables the oxygen content in the chamber to be maintained at a desired value.

The air feed inlet 11 opens out into a feed duct 12 which is advantageously but not necessarily defined between the walls 9A and 9B of the oven 2, opening out at both ends into the inlet and outlet end portions 5 and 6 of the chamber 4. A fan 13 is mounted in the air feed duct 12.

Several zones are defined within the oven: a varnish baking zone A; a solvent evaporation zone B situated in the immediate vicinity of the inlet 5 for the wire 3; and a zone C for treating evaporated solvents by combustion.

According to the invention, the fan 13 and the air feed inlet 11 are situated in distinct positions that are spaced apart from each other; more precisely, the fan 13 is situated between the solvent evaporation zone B and the air feed inlet 1 so as to entrain the solvents towards the air feed inlet 11 in order to enable the solvents to be treated by combustion in the solvent treatment zone C, away from the varnish baking zone A. In other words, as the wire 3 coated in its layer of varnish travels through the chamber 4 in the right to left direction in the FIGURE as represented by arrow F, the solvent evaporates from the varnish layer in zone B. The solvent vapor in zone B is entrained by the fan 13 towards the air feed inlet 11 and the zone C, and is subsequently burned completely in the zone C. The flow of gas inside the oven 2 is represented by arrows G and takes place in the direction opposite the direction F within the zone A.

Thus, in the invention, the fan 13 is situated in front of the air feed inlet 11 relative to the gas flow direction C.

Naturally, the present invention is not limited to the embodiment described above.

In particular, the controlled feeding of air to the chamber can be performed in a manner other than that shown, with the feed duct not necessarily being integrated in one of the walls of the oven.

In addition, the coating device may comprise a plurality of assemblies analogous to the assembly constituted by the applicator 1 and the oven 2, said assemblies then being mounted one after another.

Finally, any means may be replaced by equivalent means without going beyond the ambit of the invention.

What is claimed is:

1. A device for coating a conductor wire, the device comprising:

an enameling oven, said oven having a chamber through which said wire, coated in an enameling varnish, passes, and being provided for this purpose with a wire inlet and a wire outlet, and with means for heating said wire along its path within said chamber in order to evaporate solvent from said varnish and bake said varnish on said wire, the atmosphere inside said chamber having low oxygen content, said chamber further maintaining a fan and an air feed inlet communicating with said chamber and servo-controlled to means for measuring said oxygen content, wherein said fan and said air feed inlet are situated in distinct positions that are spaced apart from each other, said fan being situated between the solvent evaporation zone and said air feed inlet in such a manner as to entrain said solvent towards said air feed inlet so that said solvent is treated by combustion outside the zone in which said varnish is baked; and said device having an air feed duct inside said oven, communicating at its two ends with said chamber, and also with said air feed inlet, so as to form a closed gas circulating circuit, said circuit comprising said varnish baking zone, said solvent evaporation zone, and said solvent combustion zone, the gas circulating around said circuit in the opposite direction to the travel direction of said wire inside said chamber.

2. A device according to claim 1, wherein the treatment of said solvent by combustion takes place in a "combustion" zone for burning said solvents and communicating with said chamber.

3. A device according to claim 1, wherein said fan is situated in front of said air feed inlet relative to the flow direction of said solvent.

* * * * *